United States Patent [19]

Ward

[11] 4,125,982

[45] Nov. 21, 1978

[54] FLOOR JOIST INSULATION BAFFLE

[76] Inventor: Bruce K. Ward, 2904 Virginia Ave., St. Louis Park, Minn. 55426

[21] Appl. No.: 834,321

[22] Filed: Sep. 19, 1977

[51] Int. Cl.[2] ..... E04B 1/74; E04B 2/00

[52] U.S. Cl. ..... 52/404; 52/743

[58] Field of Search ..... 52/404, 406, 407, 743

[56] References Cited

U.S. PATENT DOCUMENTS

| | | | |
|---|---|---|---|
| 2,131,268 | 9/1938 | Boes | 52/404 X |
| 3,160,987 | 12/1964 | Pinkley | 52/407 |
| 3,246,438 | 4/1966 | Harting | 52/404 |
| 3,364,941 | 1/1968 | Harder | 52/743 X |
| 3,619,437 | 11/1971 | McDonald | 52/743 X |
| 3,992,829 | 11/1976 | Schellberg et al. | 52/404 x |

*Primary Examiner*—J. Karl Bell

*Attorney, Agent, or Firm*—Burd, Braddock & Bartz

[57] ABSTRACT

A baffle for retaining insulation between the base plate and the floor of a structure to provide insulation between adjacent floor joists. The baffle is a flat sheet member having foldable bottom and top flanges and foldable side flanges. The flanges are connected to the body with fold or crease lines which aid in the folding of the flanges to accommodate the size of the openings between adjacent floor joists, the ceiling and the top of the basement wall. The body has a circular crease with a plurality of flaps. The flaps can be bent to provide an opening into the space behind the baffle. The opening is used to fill the space with insulation material.

22 Claims, 6 Drawing Figures

FLOOR JOIST INSULATION BAFFLE

BACKGROUND OF THE INVENTION

It is well known that there is considerable heat loss from a building, such as a home, from the basement area. The space between the top of the basement wall and the ceiling has only a minimum of insulation so that considerable heat is lost in this manner to the outside atmosphere. Matte type insulating materials have been used to close the space between adjacent floor joists beneath the floor.

SUMMARY OF THE INVENTION

The invention is directed to a baffle that can be located between adjacent floor joists to provide a wall for retaining insulation material between the floor joists under the floor and above the base plate of a structure, such as a home. The baffle is a one-piece sheet member having a central body. Horizontal bottom and top flanges are articulately connected to the body with fold or score lines. The top flange can have a selected width in accordance with the width of the floor joists. Side flanges are articulately connected to opposite sides of the body with vertical fold or score lines. A plurality of side by side score lines are used to connect each side flange to the body. This permits the baffle to be used with different spacings of floor joists. The center portion of the body has a flap structure which can be opened to permit insulating material to be located in the space behind the baffle.

An object of the invention is to provide a low-cost one-piece floor joist baffle that can be used with different types of floor joists, as well as different spacings between adjacent floor joists. A further object of the invention is floor joists. A further object of the invention is to provide a floor joist baffle that can be made from a flat sheet material and is shipped in the flat condition and is readily foldable to a usable position at the job site. These and other objects of the invention are set forth in the following detailed description thereof.

IN THE DRAWINGS

DESCRIPTION OF PREFERRED EMBODIMENT

Figure 1:
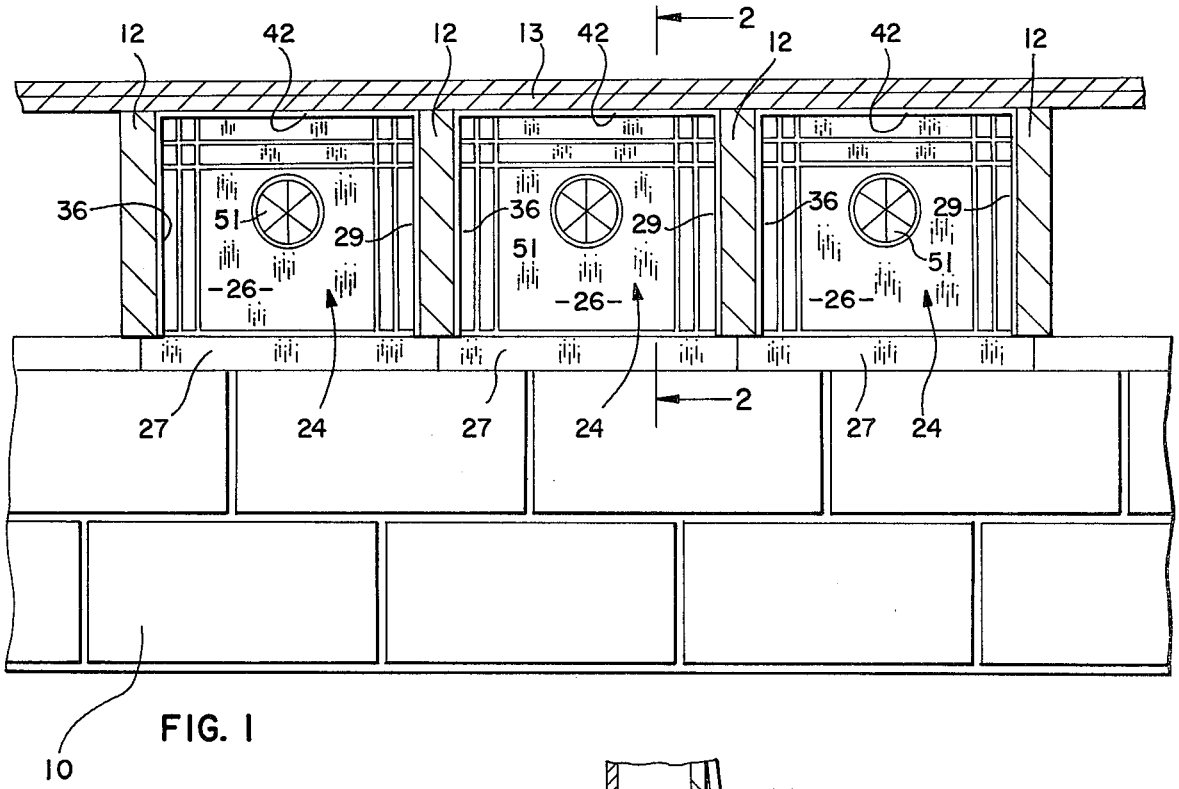
FIG. 1 is an elevational view of a section of a basement wall supporting floor joists provided with joist baffles of the invention.
Figure 2:
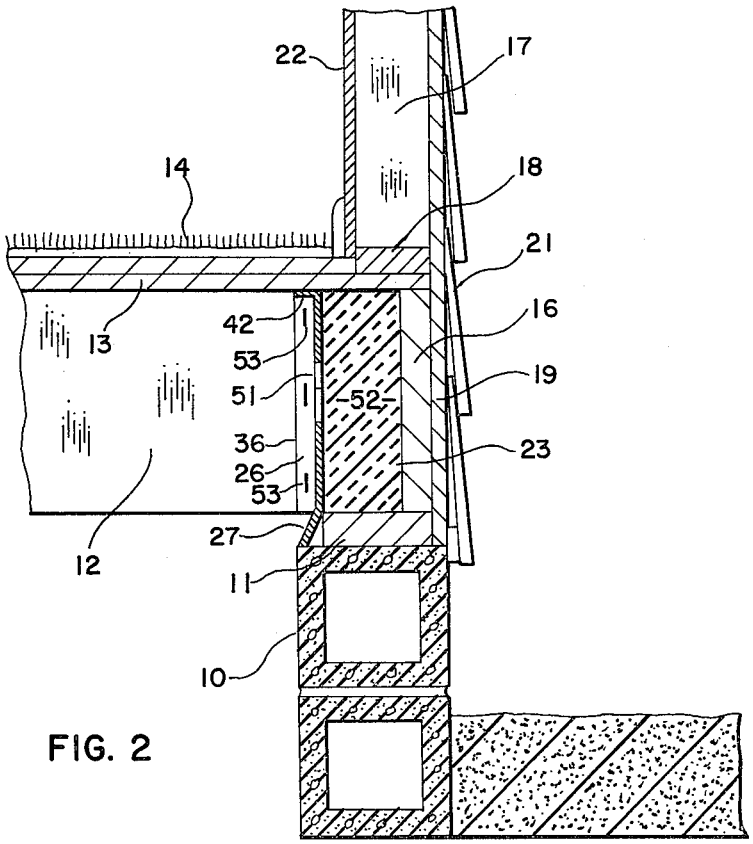
FIG. 2 is an enlarged sectional view taken along line 2—2 of FIG. 1.
Figure 4:
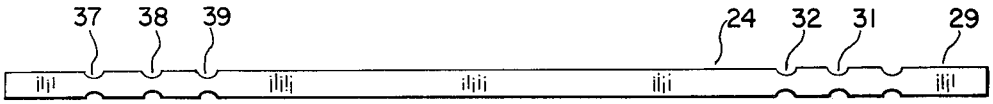
FIG. 4 is a top plan view of FIG. 3.
Figure 3:
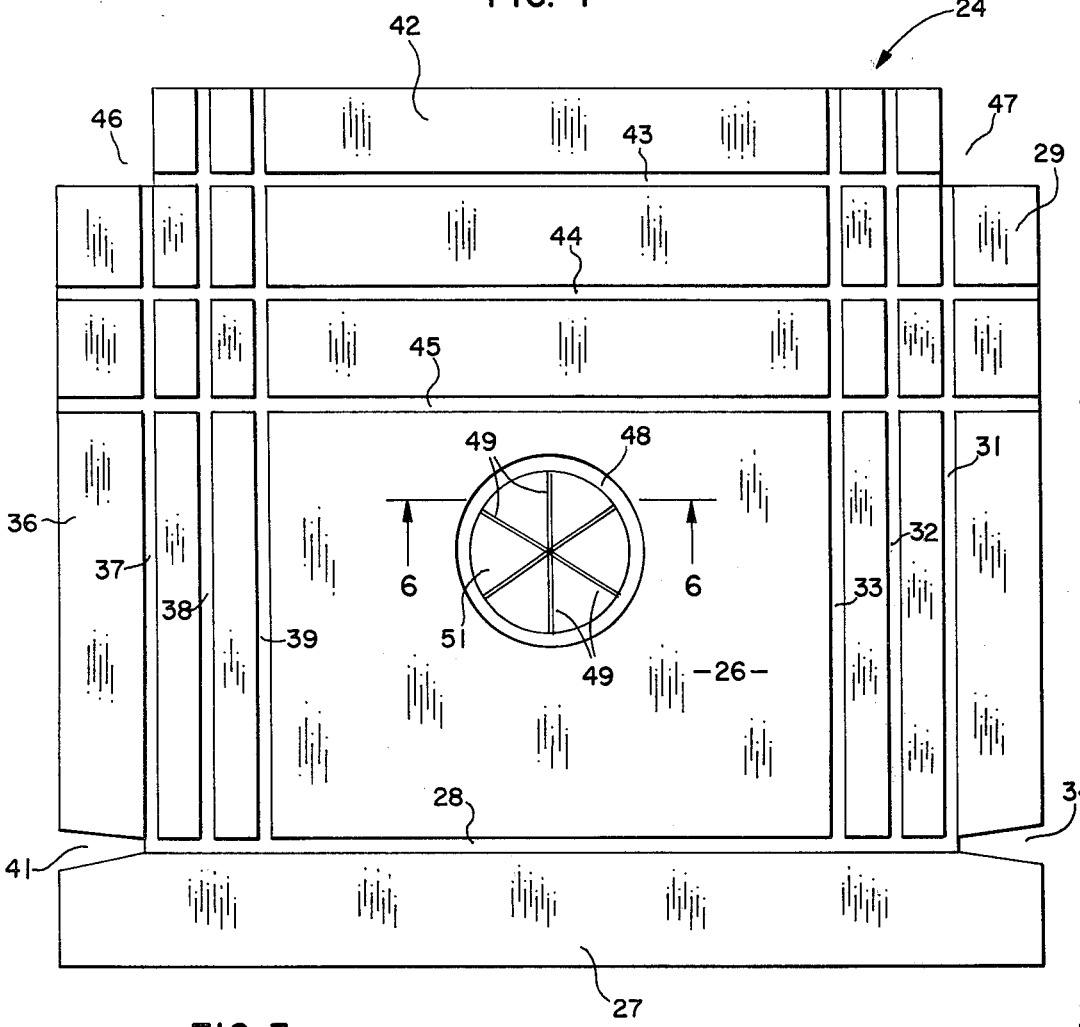
FIG. 3 is a plan view of the joist baffle before being mounted between adjacent floor joists.
Figure 5:
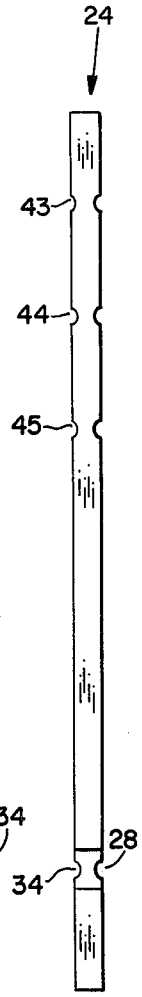
FIG. 5 is a side view of the right side of FIG. 3.
Figure 6:
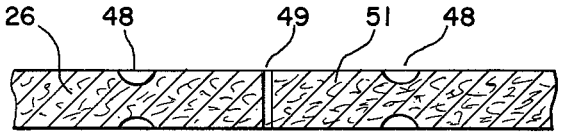
FIG. 6 is an enlarged sectional view taken along line 6—6 of FIG. 3.

Referring to FIGS. 1 and 2, there is shown a portion of a basement wall indicated at 10 for supporting a floor. A horizontal base plate 11 is located along the top of the wall 10. The wall 10 is of a conventional cement block construction. Other types of wall structure, including wood and concrete walls, is within the ken of this disclosure. A plurality of horizontal floor joists 12 are supported on plate 11. Joists 12 are the conventional usually 2 × 12 lumber. In some, cases, the floor joists are 2 × 10 or 2 × 8. Floor joists 12 support a sub-flooring 13. A carpet 14 covers the top of flooring 13. Transverse cover boards 16 are secured to the ends of the joists 11 to close the space between adjacent joists. Supported on top of the flooring 12 are upright wall studs 17 attached to a horizontal base member 18. The wall studs 17 and base member 18 are conventional 2 × 4 wood members. The outside sheathing 19 is attached to the wall studs 17 and cover board 16. In some cases, insulating sheet material is attached to the outside of a sheathing 19. Horizontal overlapping siding 21 is attached with conventional fasteners, as nails, to sheathing 19. The dry wall 22 is attached to the inside of the wall studs 17 to provide the inside walls of the structure. This structure provides for a minimum of insulating between the outside and the spaces between adjacent floor joists immediately above base plate 11. Substantial amounts of heat are lost from the structure if this space if not properly insulated.

A baffle indicated generally at 24 of this invention is used as an inside wall or holding member to define a space 23 for accommodating insulation material 52, such as foamed plastic, vermiculite, and other insulating materials.

Referring to FIGS. 3–6, baffle 24 is a flat sheet member made from sheet material such as cardboard, plastic, and hardboard, and foamed sheet plastic material. This foam sheet plastic material can be sheet polystyrene or polyurethane.

Baffle 24 has a generally rectangular central body 26. A bottom horizontal flange 27 is integral with the lower edge of body 24. A horizontal fold or score line 28 hingedly or articulately connects flange 27 to body 26. A first vertical side flange 29 is articulately connected to one side of body 26 with a plurality of vertical fold or score lines 31, 32, and 33. The score lines 31, 32 and 33 are horizontally spaced from each other to provide the flange 29 with a varying width. A notch or cut out 34 separates the bottom of flange 29 from the top outer edge of bottom flange 27.

A second side flange extends vertically adjacent the opposite side of body 26. A plurality of horizontally spaced fold or score lines 37, 38, and 39 articulately connect a flange 36 to body 26. An inwardly directed notch or cut out 41 separates the bottom of flange 26 from the top and outer edge of the bottom flange 27. The notches 34 and 41 permit the flanges 29 and 36 to be folded relative to the body without affecting the folding of bottom flange 27.

Extended across the top of body 26 is a top horizontal flange 42. A plurality of horizontal fold or score lines 43, 44, and 45 articulately connect the flange 42 with the top of body 26. The corners between the upper ends of flanges 29 and 36 and the ends of top flange 42 are cut out at 46 and 47 to permit the upper part of flange 42 to be folded along the fold line 43 without affecting the folding of the side flanges 29 and 36. The horizontal fold lines 43, 44, and 45 allow the baffle 24 to be used with floor joists that are 2 × 12, 2 × 10, and 2 × 8. The vertical score lines 31, 32, 33, 37, 38, and 39 permit variations in the spacing between adjacent floor joists and the occasional construction where double joists are used. The spacing between the adjacent vertical score lines can vary. Preferably, the spacing is about three-quarters of an inch or 2cm. Other spacings can be used.

The center portion of the central body 26 has a circular score 48 providing an articulated connection for a plurality of radially inwardly directed flaps or doors 51. Flaps 51 are segments of a circle having a general triangular shape with an arcuate outer edge. Radial slits 49 separate adjacent flaps 51 so that the flaps can be foled in to provide an entrance opening into the space behind the baffle. A tubular member can be used to open to flaps 51 so that insulation material can be blown into the space 23. As shown in FIG. 2, space 23 is filled with insulation material 52. Flaps 51 have been folded back to their original positions to close the opening.

In use, baffle 24 is made in a flat position with and die cut from a sheet material, such as cardboard. The cardboard can be treated with fireproof material. Other types of sheet materials, as plastic, metal, paper, wood and plywood, can be used to make baffle 24. Baffle 24 at the job site is placed between adjacent floor joists as shown in FIG. 1. The bottom flange 27 rests on top of the wall 10 with the top flange being folded inwardly in engagement with the bottom of score 13. The side flanges 29 and 36 are folded along one of the fold lines and engage the sides of the floor joists. Fasteners 53 such as staples, nails, adhesives, and the like, are used to attach flanges 29 and 36 to the sides of adjacent joists.

The insulation material is moved through the opening formed by the flaps 51. This can be done with a tubular member for carrying the insulation material into the space 23. Suitable blowing materials can be used to convey the insulation material through the tubular member.

While it has been shown and described, the preferred embodiment of the baffle of the invention, it is understood that changes in the structure and materials can be made by those skilled in the art without departing from the invention.

The invention is defined in the following claims.

The embodiments of the invention in which an exclusive property or privilege is claimed are defined as follows:

1. A baffle locatable between a base plate on top of a basement wall, floor and floor joists supported on the base plate of a structure for retaining insulation material in the space between adjacent floor joists and above the base plate comprising:

a generally flat body having a top portion, a bottom portion and side portions, said body having a size to close the space between base plate, floor, and adjacent floor joists, said body having means for providing an opening through the body whereby insulation material can be placed behind the body to fill the space behind the body, a first flange movably joined to the top portion engageable with the floor, a bottom flange movably joined to the bottom portion locatable adjacent the base plate, and side flanges movably joined to the side portions engageable with adjacent floor joists and above the base plate.

2. The baffle of claim 1 wherein:

the means for providing an opening through the body comprises a plurality of separate flaps movably joined to the body.

3. The baffle of claim 2 wherein:

the flaps are segments of a circle, each segment being movably joined to the body with an arcuate score.

4. The baffle of claim 1 wherein:

each of the flanges is movably joined to the body with a linear score.

5. The baffle of claim 1 wherein:

the top flange and side flanges are movably joined to the body with a plurality of linear scores.

6. The baffle of claim 1 wherein:

the body and all flanges are a single sheet member.

7. The baffle of claim 1 including:

a first notch separating a part of one side flange from the bottom flange and a second notch separating the other side flange from the bottom flange.

8. The baffle of claim 7 wherein:

the means for providing an opening through the body comprises a plurality of separate flaps movably joined to the body.

9. The baffle of claim 8 wherein:

the flaps are segments of a circle, each segment being movably joined to the body with an arcuate score.

10. The baffle of claim 7 wherein:

the top flange and side flanges are movably joined to the body with a plurality of linear scores.

11. A baffle locatable between a base plate on top of a basement wall, floor and floor joists of a structure for retaining insulation material in the space between adjacent floor joists and above the base plate comprising:

a body having a top portion, bottom portion, and side portions, and at least one side flange movably joined to one of the side portions and engageable with one floor joist to close the space between adjacent floor joists and above the base plate, said body having a size to close the space between base plate, floor, and adjacent floor joists, said body having means for providing an opening through the body whereby insulation material can be placed behind the body to fill the space behind the body.

12. The baffle of claim 11 wherein:

the means for providing an opening through the body comprises a plurality of separate flaps movably joined to the body.

13. The baffle of claim 12 wherein:

the flaps are segments of a circle, each segment being movably joined to the body with an arcuate score.

14. The baffle of claim 11 including:

a second side flange movably joined to the other side portion of the body and engagable with the other floor joist.

15. The baffle of claim 14 wherein:

the second side flange is movably joined to the other side portion of the body with a linear score.

16. The baffle of claim 11 including:

a top flange movably joined to the top portion of the body and engagable with the floor.

17. The baffle of claim 16 wherein:

the top flange is movably joined to the top portion of the body with a linear score.

18. The baffle of claim 11 including:

a bottom flange movably joined to the bottom portion of the body.

19. The baffle of claim 18 wherein:

the bottom flange is movably joined to the bottom portion of the body with a linear score.

20. The baffle of claim 11 including:

a second side flange movably joined to the other side portion of the body, a top flange movably joined to the top portion of the body and engageable with the floor, said one side flange, second side flange, and top flange being movably joined to the body with a plurality of generally parallel linear scores.

21. The baffle of claim 20 wherein:

the means for providing an opening through the body comprises a plurality of separate flaps movably joined to the body.

22. The baffle of claim 21 wherein:

the flaps are segments of a circle, each segment being movably joined to the body with an arcuate score.

* * * * *